US005085046A

United States Patent [19]

Fehrer

[11] Patent Number: 5,085,046

[45] Date of Patent: Feb. 4, 1992

[54] PROCESS AND APPARATUS FOR FEEDING AT LEAST TWO DRAWN ROVINGS TO RESPECTIVE RING SPINNING STATIONS

[76] Inventor: Ernst Fehrer, Auf der Gugl 28, A-4020 Linz, Austria

[21] Appl. No.: 304,723

[22] Filed: Jan. 31, 1989

[30] Foreign Application Priority Data

| | | | |
|---|---|---|---|
| Feb. 15, 1988 | [AT] | Austria | 330/88 |
| Mar. 14, 1988 | [AT] | Austria | 682/88 |
| Mar. 29, 1988 | [AT] | Austria | 834/88 |
| Jun. 1, 1988 | [AT] | Austria | 1429/88 |
| Jun. 9, 1988 | [AT] | Austria | 1497/88 |
| Jun. 29, 1988 | [AT] | Austria | 1687/88 |
| Jul. 22, 1988 | [AT] | Austria | 1876/88 |
| Nov. 23, 1988 | [AT] | Austria | 2874/88 |

[51] Int. Cl.[5] ..... D01H 1/02; D01H 5/72

[52] U.S. Cl. ..... 57/315; 57/75

[58] Field of Search ..... 57/315, 328, 331, 400, 57/401, 408, 409, 90, 75; 19/236, 150, 151, 157, 292

[56] References Cited

U.S. PATENT DOCUMENTS

| | | | |
|---|---|---|---|
| 365,280 | 6/1887 | Thomas | 19/292 |
| 2,274,424 | 2/1942 | Miller | 19/150 |
| 3,018,521 | 1/1962 | Harmon | 19/150 |
| 3,135,023 | 6/1964 | Kalwaites | 19/150 |
| 3,230,584 | 1/1966 | Kalwaites | 19/150 |
| 4,672,800 | 6/1987 | Fehrer | 57/328 X |
| 4,676,062 | 6/1987 | Brockmanns et al. | 57/328 X |
| 4,724,668 | 2/1988 | Wassenhoven | 57/400 X |
| 4,783,956 | 11/1988 | Stadler | 57/331 X |

FOREIGN PATENT DOCUMENTS

| | | | |
|---|---|---|---|
| 3988 | 2/1979 | Japan | 57/328 |

*Primary Examiner*—Jodrph J. Hail, III

*Attorney, Agent, or Firm*—Collard, Roe & Galgano

[57] ABSTRACT

In order to avoid the need for providing expensive fine rovings, a process is proposed in which two rovings are supplied to respective ring spinning stations (3). A common primary roving (2) is drawn and is subsequently divided into two separate rovings (2*a*, 2*b*) for feeding respective ring spinning stations (3). The primary roving (2) is divided into two separate rovings (2*a* and 2*b*) by conveying means (11), which comprise two juxtaposed suction zones (12*a*, 12*b*), which extend in the direction of conveyance.

14 Claims, 4 Drawing Sheets 19
16
11
12a
10
12b
14
17
18
18
13
9
1
2a
2b
15
15
3
5
5
6
6
4
4
8
8
7
7
3

FIG. 2
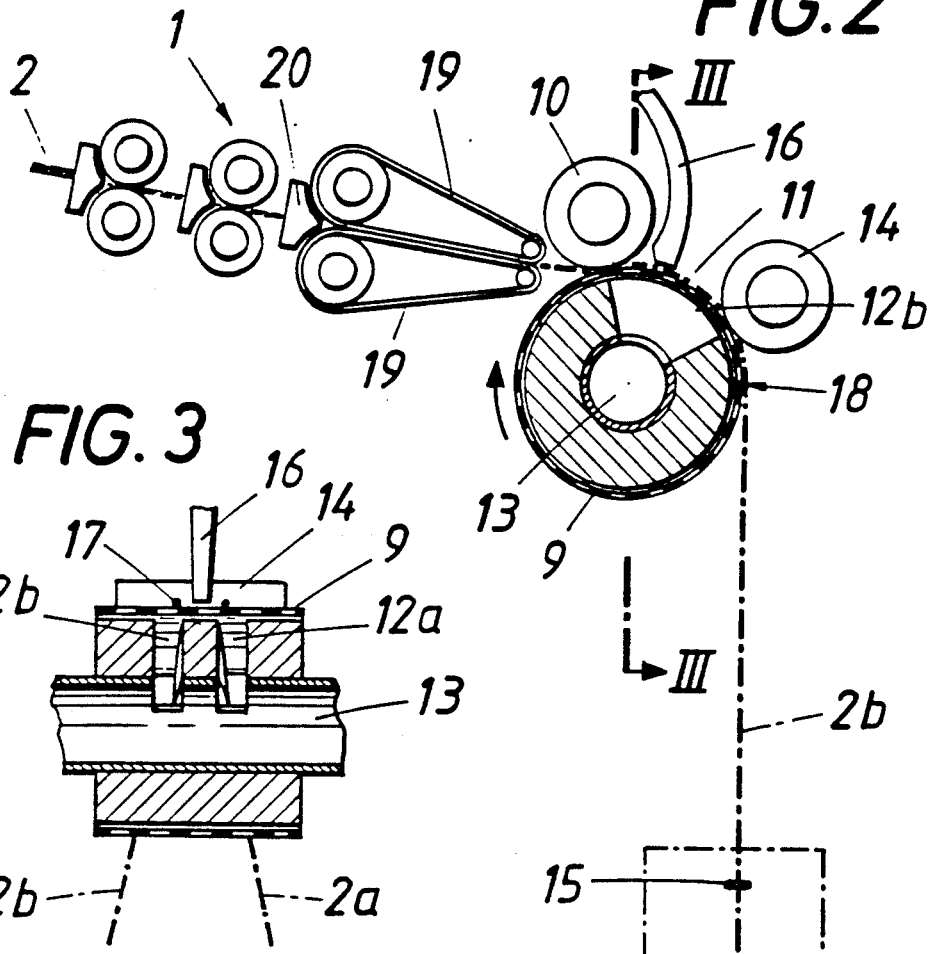
FIG. 3
FIG. 4
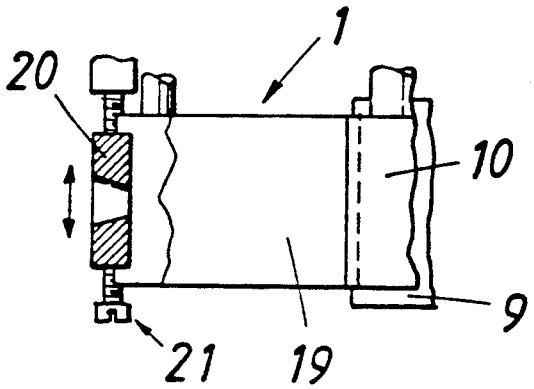

FIG.7
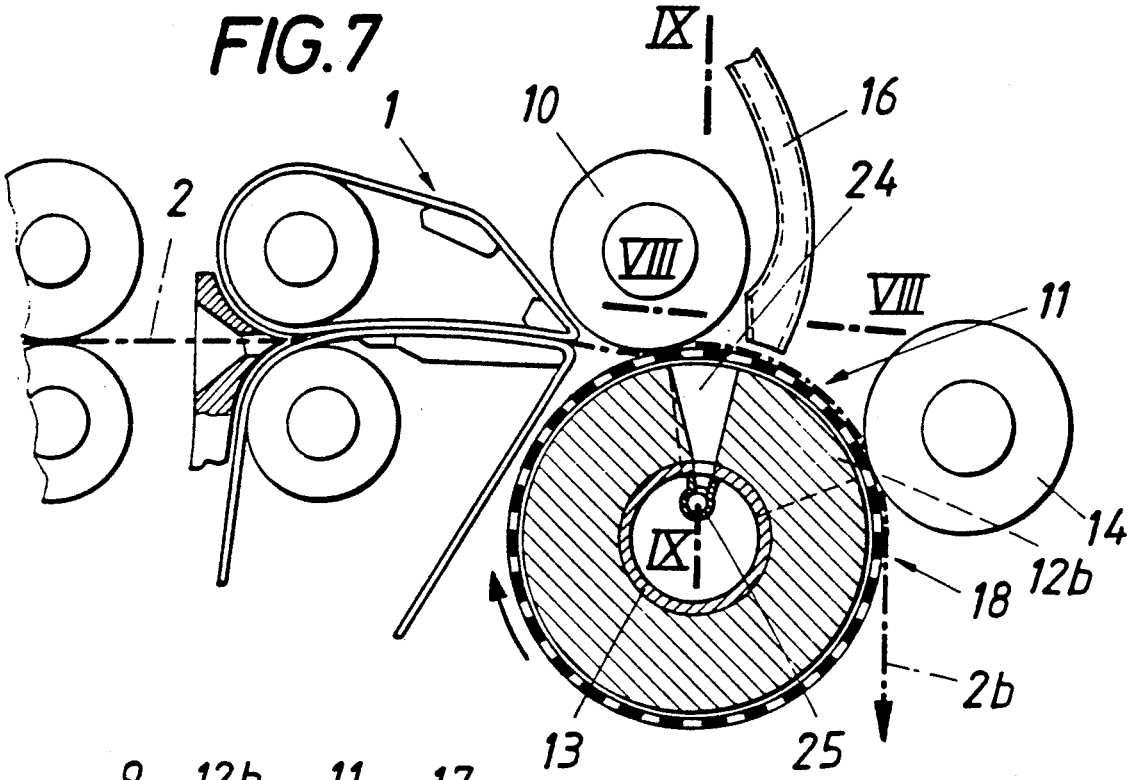
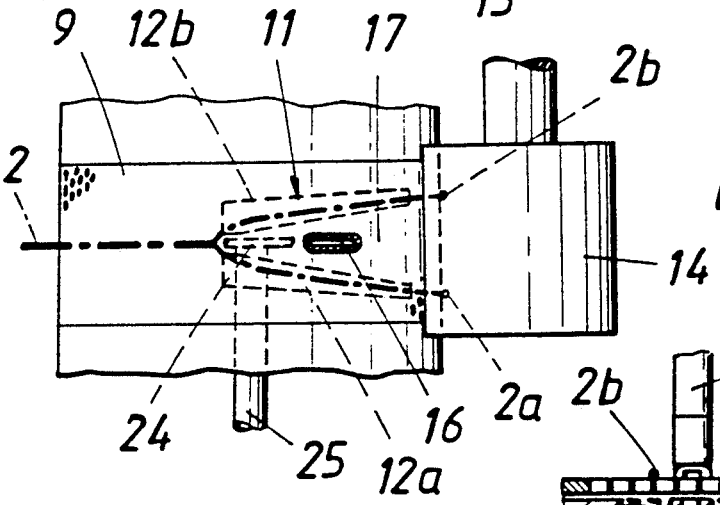
FIG.8
FIG.9
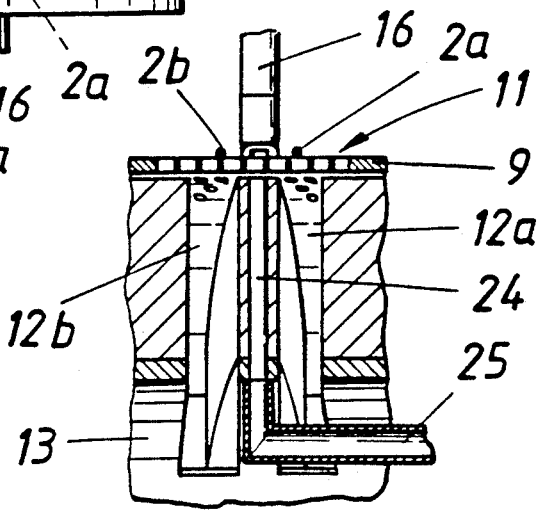

PROCESS AND APPARATUS FOR FEEDING AT LEAST TWO DRAWN ROVINGS TO RESPECTIVE RING SPINNING STATIONS

BACKGROUND OF THE INVENTION

1. Field of the Invention

This invention relates to a process of feeding at least two drawn rovings to respective ring spinning stations and to an apparatus for carrying out the process.

2. Description of the Prior Art

Each spinning station of known ring spinning machines is preceded by a drawing frame, from which a drawn fine roving is withdrawn through an eyelet and through a traveller revolves on a ring is fed to a bobbin which is non-rotatably mounted on a driven spindle. In such machines each revolution of the traveller will result in a turn of the yarn and the difference between the speeds of the leading bobbin and the trailing traveller will determine the velocity at which the yarn is wound up. Fine yarns cannot be made in such case unless the rovings supplied to the drawing frames are sufficiently light in weight per unit of length. For this reason said rovings must be subjected to a relatively expensive pretreatment to form a fine roving if the strength and uniformity which are required for ring spinning are to be achieved.

SUMMARY OF THE INVENTION

For this reason it is an object of the invention to provide a process in which the spinning stations of a ring spinning machine can be supplied with drawn rovings without a need for supplying expensive fine rovings which are light in weight.

This object is accomplished in accordance with the invention in that a primary roving which is used to feed both ring spinning stations is drawn and the drawn primary roving is divided into at least two separate rovings to be fed to respective ring spinning stations.

Because a drawn primary roving is divided into two separate rovings, it is not necessary to supply expensive fine rovings. As a result, rovings may be supplied which have a correspondingly higher weight per unit of length and this will not adversely affect the spinning conditions adjacent to each spinning station. Besides, the drawing of a roving will depend on the frictional resistance between the individual fibers of the fibrous structure so that a primary roving which is relatively heavy in weight can be drawn without a need for special measures. Nevertheless, the rovings into which the drawn primary roving is divided will meet all requirements also for the making of very fine yarns. Whereas it will generally be recommendable to divide the drawn primary roving into two rovings, a further division may be adopted if this is desired.

The process may be carried out with an apparatus comprising a drawing frame for drawing the primary roving and at least two ring spinning stations, which succeed the drawing frame. That apparatus is characterized in that the ring spinning stations are preceded by conveying means for conveying the common drawn primary roving, which conveying means comprise a revolving conveying surface including at least two separate suction zones, which extend one beside the other in the direction of conveyance and serve to divide the primary roving into separate rovings to be fed to respective ring spinning stations. The primary roving which enters the range of said two suction zones will be divided into two separate rovings because the fibrous structure disposed between the two suction zones will be pulled apart toward said suction zones to form two strands.

To be divided, the primary roving must be constrained to move adjacent to at least two juxtaposed suction zones so that a conveyor having a revolving conveying surface is provided. That conveying surface may be constituted by a revolving belt or a rotating disk. Particularly desirable conditions will be obtained if the conveying means comprise a rotating feed roller having at least two axially juxtaposed suction zones, which extend over a part of the periphery of the roller and along which the drawn primary roving is divided into two separate rovings. In such case the length in which the drawn primary roving moves without a constraint should be minimized. To that end the feed roller may be constituted by one of the delivery rollers of the drawing frame used to draw the primary roving. In that case the primary roving will be divided into two separate rovings immediately after the primary roving has been drawn.

A blast nozzle which is directed against the conveying surface may be provided. In that case the two separate rovings will be urged apart also by the air blast from the blast nozzle and this will not adversely affect the conveyance of the separate rovings on the conveying surface and will not disturb the alignment of the fibers of the separate rovings in the latter. Because the fibers of the separate rovings will be retained on the conveying surface by the suction zones, the air blast which urges the two separate rovings apart will also tend to condense the rovings.

Favorable conditions regarding the spreading of the two separate rovings will be provided if the blast nozzle consists of a slot nozzle, which extends in the direction of conveyance and spreads the separate rovings along a relatively large conveying path.

The dividing of the common primary roving into separate rovings may be assisted in that a suction-free intermediate zone, which flares in the direction of conveyance, is provided between the suction zones and the latter taper in the direction of conveyance. In that case the distance between the two separate rovings will be increased and the suction-free intermediate zone which is disposed between the suction zones and flares in the direction of conveyance will desirably constitute a deflecting surface for the air blast from any blast nozzle which may be provided. As a result, such air blast will be divided into two oppositely directed separate streams, which flow transversely to the separate rovings and are sucked off in the suction zones and assist the spreading of the separate rovings and ensure that the separate rovings will desirably be condensed. The suction zones which taper in the direction of conveyance conform to the course of the separate rovings and ensure also that the suction stream will be distributed in accordance with existing conditions along the length in which the suction zones extend in the direction of conveyance. Relatively strong suction forces for dividing the drawn primary roving into two separate rovings will be required in the receiving portions of the suction zone and only guiding functions are to be performed by the suction forces adjacent to the blast nozzle. For this reason the change of the width of the suction zones and the blast nozzle directed toward the suction-free intermediate zone between the suction zones will ensure also a desirable utilization of energy because a suction stream requires a much higher energy than a blast.

In order to ensure a uniform division of the roving into at least two separate rovings without a risk that the separate rovings may influence each other when the division has been effected, a blast zone for delivering a blast of air that has flown through the conveying surface may be provided also in the suction-free intermediate zone which is disposed between the suction zones and said air blast will then properly be divided by and sucked through the suction zones of the conveying surface. In that case the primary roving which has entered the range of said air streams will desirably be divided.

The actions which are exerted by the air blast on the separate rovings will be varied if the blasting zone is shifted in the direction of conveyance. An air blast from a blasting zone adjacent to the delivery end of the suction zones will hardly influence the dividing of the primary roving, which in that case will be divided substantially by the suction stream produced by the suction zones. But the air blast in the delivery part of the suction zones may assist the spreading of the separate rovings which have been formed. For this reason, desirable conditions for the dividing will be obtained if the blast zone extends close to the receiving end of the suction zones.

If a blast zone for delivering an air blast which has flown through the conveying surface is combined with a blast nozzle that is directed toward the conveying surface, particularly desirable conditions for the dividing of the primary roving will be provided if the blast nozzle is directed to the intermediate zone which in the direction of conveyance succeeds the delivery end of the blasting zone because different actions, which supplement each other, will be produced in that case by the blasts from the blasting zone and from the blast nozzle. In such an arrangement the air blast from the blasting zone will assist the division of the primary roving into two separate rovings and the air blast from the blast nozzle will assist the spreading and condensing of the separate rovings which have been formed from the primary roving.

Because the energy required to divide the drawn primary roving into two separate rovings is to be minimized, the suction zones should be as short as possible. To that end the suction zones may terminate at a distance before the delivery end of the conveying means. Surprisingly it has been found that when the two separate rovings have been moved sufficiently apart they will be guided on the conveying surface even when they are not sucked thereto.

The separate rovings may be guided on the conveying surface by means of a roller which is associated with the conveyor and applies pressure to the separate rovings. In that case the points of departure of the separate rovings will be defined and the condensing of the rovings will effectively be assisted. The transverse forces exerted by the divided air blast will act on rovings, which toward the delivery end are retained against a transverse displacement. Whereas clamping forces for a high-draft drawing of the primary roving are required in the nip between the delivery rollers of the drawing frame, such forces need not be exerted in the guiding gap defined by the pressure applying roller, where it is merely necessary to exert guiding forces which prevent a lateral wandering. For this reason the width of the condensed separate rovings will not appreciably be increased as they are conveyed through said guiding gap and because the separate rovings substantially correspond in their cross-sectional shape to the yarns which are to be made, the separate rovings can conveniently be twisted by the respective succeeding ring spinning stations.

If the pressure-applying roller is spaced before the delivery end of the conveying means, the twist which is imparted to the separate rovings by the ring spinning stations will extend along the conveying means as far as to the guiding gap between the pressure-applying roller and the conveying surface so that the fiber ends which protrude from the separate rovings will be wound around the separate rovings as they are rotated. This is due to the fact that the rotation of the roving will cause the protruding fiber ends to be deflected by the conveying surface transversely to the axis of the roving and will cause said fiber ends to be wound around the associated roving. That additional winding of the protruding fiber ends around the separate rovings will improve the alignment of the fibers owing to the condensing of the fibers and will appreciably increase the strength of the yarn.

As the primary roving is divided into at least two separate rovings, the fibers of the primary roving will be pulled apart and individual fibers may be sucked at one end toward one suction zone and at the other end toward the other suction zone so that such fibers may form bridges between the separate rovings adjacent to the suction zones. Such bridges may tend to move the separate rovings toward each other. A formation of such bridges by individual transverse fibers will be prevented if a fiber stripper is associated with the conveying surface in the suction-free intermediate zone between the suction zones and/or in the succeeding peripheral portion because such fiber stripper will permit transverse fibers to be conveyed only to one of the separate rovings.

The fiber stripper may be of any of several types and may consist, e.g., of an elastic pressure-applying member. But particularly simple conditions will be obtained if the fiber stripper consists of at least one stripping brush, which is moved into engagement with the conveying surface and prevents a further conveyance of fiber bridges between the separate rovings.

For an advantageous result of the spinning operation the drawn primary roving must be divided into the separate rovings with a constant fiber ratio. That ratio will depend on the position of the drawn primary roving relative to the two suction zones and on the distribution of fibers over the cross-section of the roving. If the roving guide associated with those drawing elements of the drawing frame which directly precede the delivery rollers is mounted to be adjustable in the direction of the width of the gap defined thereby, this will permit an exact adjustment of the distribution of ratio of the fibers contained in the two separate rovings because the distribution of the fibers of the primary roving over the cross-section thereof can be influenced by a displacement of that roving guide. In that manner a desired distribution of fibers over the width of the drawn primary roving can be enforced so that the desired division of the primary roving will be ensured if the position of the primary roving relative to the dividing means is properly selected.

BRIEF DESCRIPTION OF THE DRAWING

FIG. 2 is a side elevation showing that apparatus partly broken away.

FIG. 3 is a sectional view taken on line III—III in FIG. 2.

FIG. 4 is an enlarged sectional view taken through the high-draft field of the drawing frame on the feeding plane.

FIG. 7 illustrates another modification in a view which is similar to FIG. 5.

FIG. 8 is a sectional view taken on line VIII—VIII in FIG. 7.

FIG. 9 is a still further enlarged sectional view taken on line IX—IX in FIG. 1.

DETAILED DESCRIPTION OF THE PREFERRED EMBODIMENTS

Figure 1:
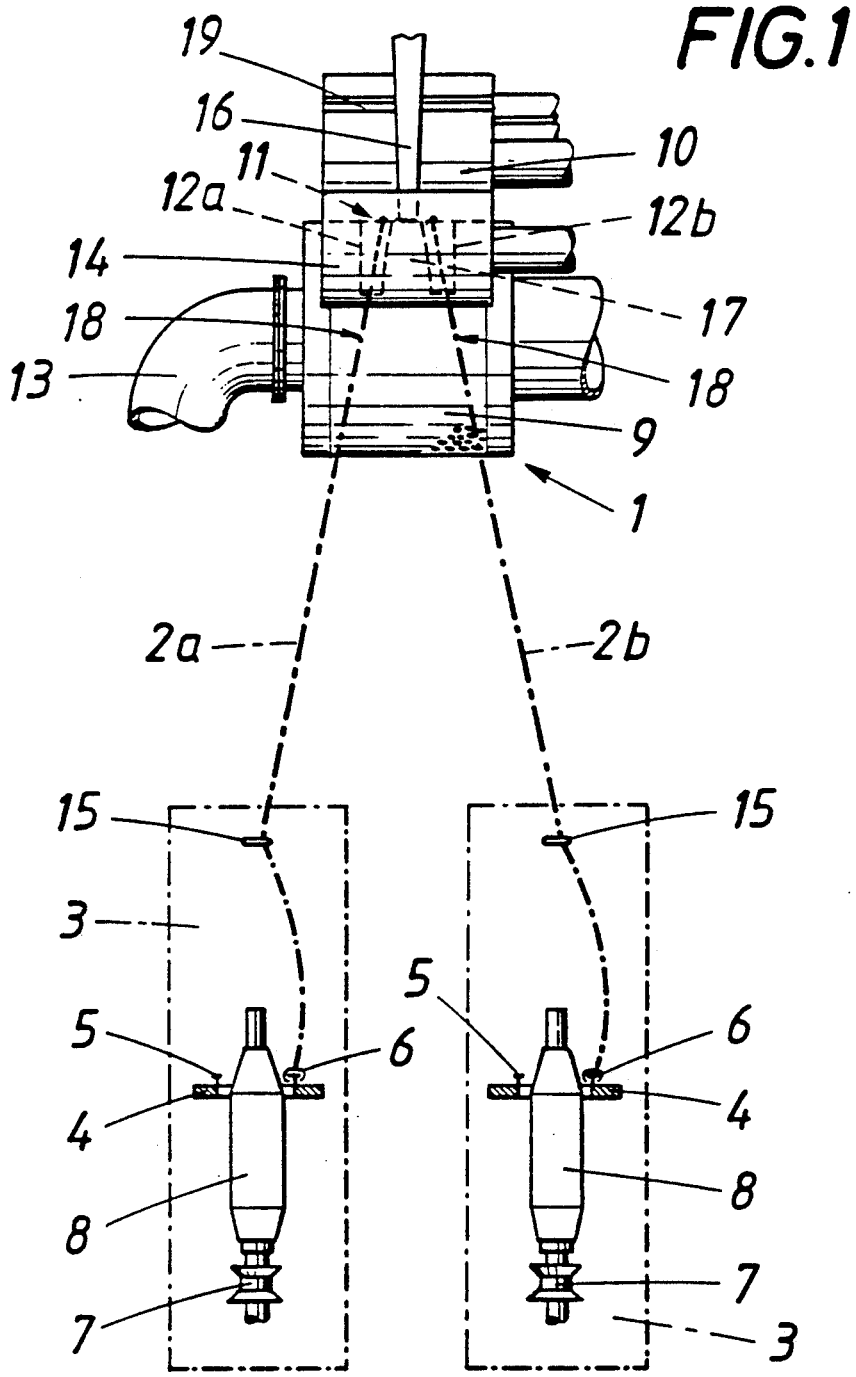
FIG. 1 is a simplified front elevation showing an apparatus in accordance with the invention for feeding two drawn rovings to respective ring spinning stations.

The invention is illustrated by way of example on the drawing.

In the illustrative embodiment shown in FIGS. 1 to 4, two ring spinning stations 3 are preceded by a common drawing frame 1 for drawing a primary roving 2. Each ring spinning station is of conventional type and comprises a ring rail 4 that is provided with a ring, a traveller 5 movably mounted on the ring 5, and a bobbin 8, which is adapted to be driven by a spindle wharve 7.

One delivery roller 9 of the pair of delivery rollers 9, 10 of the drawing frame 1 constitutes a feed roller associated with the succeeding ring spinning stations 3 and is larger in diameter than the other delivery roller 10 to constitute conveying means 11 for conveying the drawn primary roving 2. The conveying means 11 comprise two suction zones 12*a* and 12*b*, which extend one beside the other in the direction of conveyance and to which a suction is applied via a corresponding suction insert 13 of the feed roller 9. This is particularly apparent from FIG. 3.

Because the drawn roving 2 is moved on the feed roller 9 into the region of the two suction zones 12*a* and 12*b* and said suction zones are only closely spaced apart at least at their receiving end, the fibrous structure which is constituted by the primary roving 2 will be broken apart between the two suction zones 12*a* and 12*b* and will be pulled apart toward said suction zones so that the primary roving 2 will be divided into two separate rovings 2*a* and 2*b*, which are conveyed along the conveying means 11 first as far as to a pressure-applying roller 14, which together with the feed roller 9 defines a guiding gap, which prevents a lateral wandering of the separate rovings 2*a* and 2*b*. That guiding gap will control the deflection of the separate rovings 2*a* and 2*b* from the direction of conveyance of the conveyor means 11 toward the entrance eyelets 15 of the ring spinning stations 3.

The two suction zones 12*a* and 12*b* enforce a division of the primary roving 2 into two separate rovings 2*a* and 2*b*, which are fed to respective ring spinning stations 3. That division will afford the considerable advantage that only a common drawing frame 1 is required to be associated with both ring spinning stations 3 and the primary roving which is fed to that drawing frame may have a weight which is twice the weight of the roving which is required for the making of the ring-spun yarn. As a result, the expensive making of a fine roving otherwise required may be omitted and that omission will not adversely affect the result of the spinning operation because the fineness of the yarn will depend on the weight of the separate rovings 2*a* and 2*b* rather than on the weight of the primary roving 2.

In order to assist the division of the primary roving 2 into two separate rovings 2*a* and 2*b*, a blast nozzle 16 is provided between the separate rovings 2*a* and 2*b* and is directed toward the conveying surface so that the air blast which is directed by the blast nozzle 16 against the suction-free intermediate zone 17 will urge the two separate rovings 2*a* and 2*b* apart so as to increase the distance between them. The suction-free intermediate zone desirably flares in the direction of conveyance and the suction zones 12*a* and 12*b* have a corresponding taper so that the separate rovings 2*a* and 2*b* will be condensed, particularly because the pressure-applying roller 14 will prevent a lateral shifting of the separate rovings 2*a* and 2*b*. As a result, the rovings can be given a cross-sectional shape which is similar to the cross-sectional shape of the yarn that is to be made so that the twisting of the separate rovings by the ring spinning stations 3 will greatly be facilitated. This is due to the fact that the wide roving strip which has left the high-draft field of the drawing frame need no longer be condensed in a triangular region to the round cross-section of the yarn as the roving strip is twisted and the alignment of the fibers will thus be improved and a stronger yarn will be made. Besides, the pressure applying roller 14 is spaced before the delivery end 18 of the conveying means 11 and the guidance of the rovings on the feed roller behind the pressure-applying roller 14 will ensure that roving fibers which protrude from the separate rovings 2*a*, 2*b* will be wound around said rovings because the twist which is imparted to the rovings by the ring spinning stations will extend as far as to the guiding gap defined by the pressure-applying roller 14 and the feed roller 9 so that the protruding fiber ends engaging the surface of the feed roller 9 will be wound around the rotating separate rovings 2*a* and 2*b*.

An exact division of the primary roving 2 into the two separate rovings 2*a* and 2*b* will require a predetermined position of the drawn roving 2 relative to the two suction zones 12*a*, 12*b* and a proper distribution of the fibers over the cross-section of the roving. To that end a roving guide 20 may be associated with those drawing elements of the drawing frame 1 which directly precede the delivery rollers 9 and 10 and consist of drawing belts 19 and said roving guide 20 may be mounted to be adjustable in the direction of the width of the gap that is defined by said guide and may be arranged to be displaced by means of an adjusting mechanism 21, such as a screw drive. Such a displacement will highly sensitively influence the alignment of the drawn primary roving 2 relative to the suction zones 12*a* and 12*b* and the distribution of fibers over the cross-section of the roving.

Figure 5:
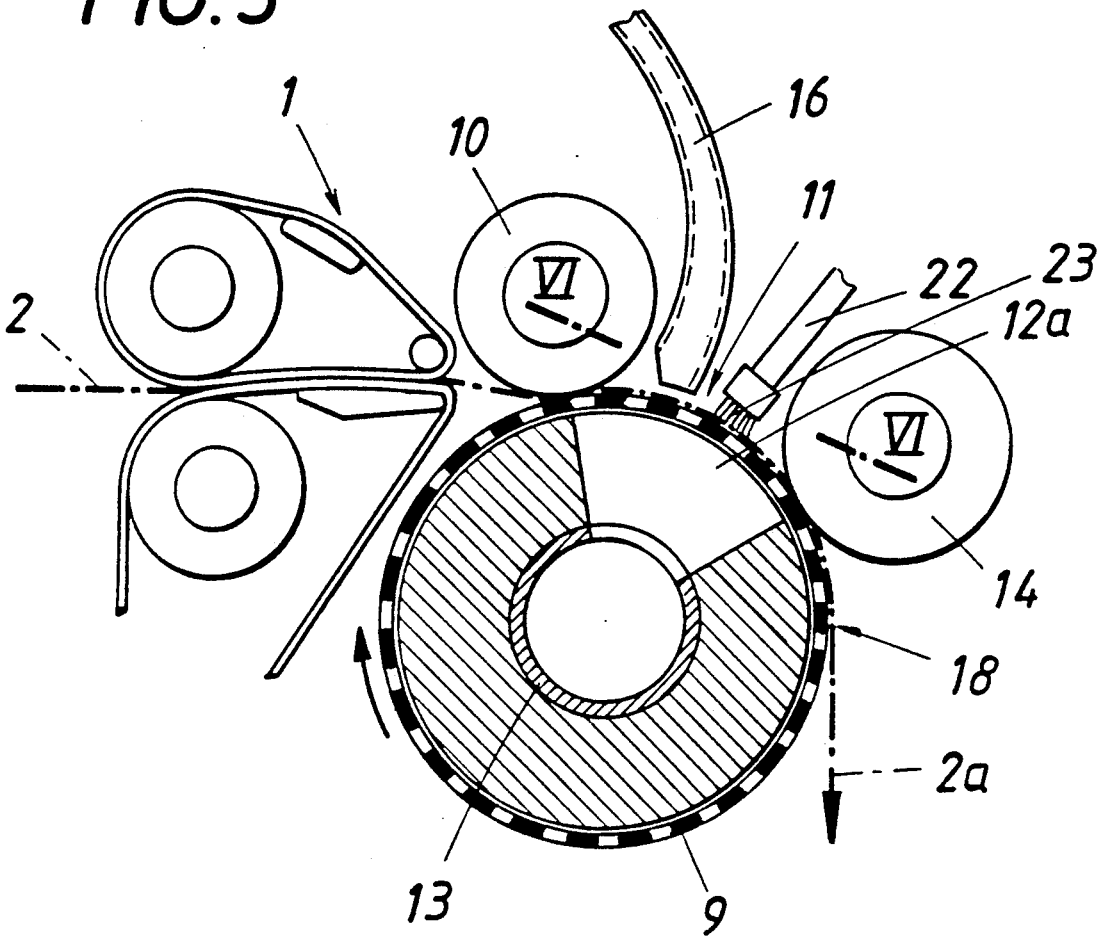
FIG. 5 is an enlarged sectional view which is similar to FIG. 2 and shows a portion of a modified apparatus in accordance with the invention.
Figure 6:
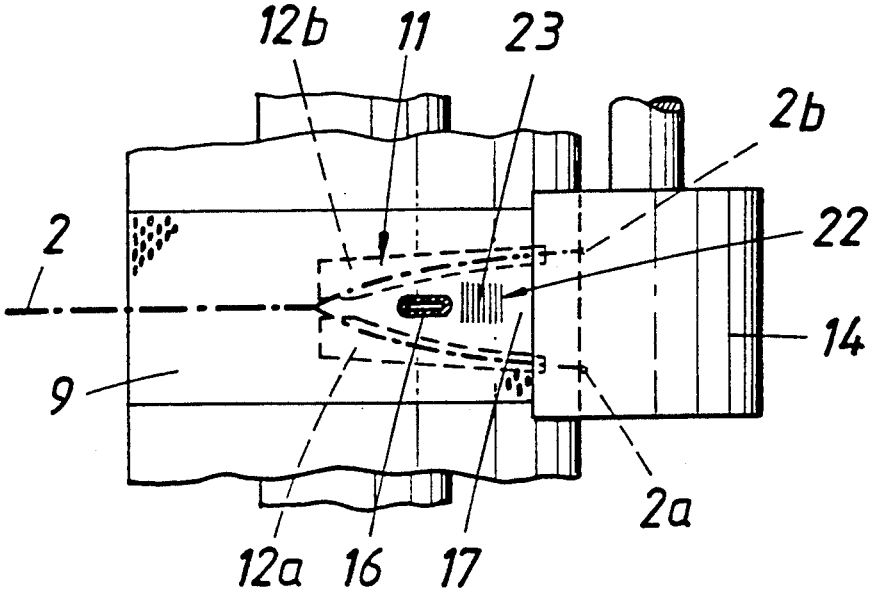
FIG. 6 is a sectional view taken on line VI—VI in FIG. 5.

The illustrative embodiment shown in FIGS. 5 and 6 differs from the illustrative embodiment shown in FIGS. 1 to 4 essentially only in that a stripper 22, which succeeds the blast nozzle 16 in the direction of rotation of the feed roller 9, is disposed in the suction-free intermediate zone 17 between the suction zones 12*a* and 12*b*, which intermediate region 17 flares in the direction of conveyance. In the illustrated embodiment that stripper 22 is constituted by a brush 23, which prevents a formation of fiber bridges between the two separate rovings 2*a* and 2*b*. Behind the pressure-applying roller 14 such fiber bridges might otherwise cause the two separate rovings 2*a* and 2*b* to influence each other as they are twisted. Each of the fibers which have been transversely stretched as the fibers of the primary roving 2 were pulled apart will be permitted by the brush to move only to one of the two separate rovings 2*a* and 2*b*. Because the separate rovings have been condensed so that the fibers need not be moved toward each other in the configuration of a triangle having a wide base when the separate rovings have left the guiding gap, the separate rovings 2*a* and 2*b* which leave the guiding gap between the pressure-applying roller 14 and the feed roller 9 can be uniformly twisted without influencing each other and this is achieved in spite of the fact that the rovings lie on the feed roller 9 until they are close to that guiding gap.

The illustrative embodiment shown in FIGS. 7 to 9 comprises in addition a blasting zone 24 in the intermediate zone 17 between the two suction zones 12*a* and 12*b*, which taper in the direction of conveyance. That blasting zone 24 extends close to the receiving end of the suction zones and is supplied with compressed air via a pressure line 25. The air blast which emerges from the feed roller 9 adjacent to the blasting zone 24 is deflected toward the suction zones 12*a* and 12*b* and is divided into two partial streams and is then sucked off. By that air stream the fibrous structure of the primary roving 2 which is fed to the feed roller 9 will be broken up and pulled apart toward the two suction zones 12*a* and 12*b* so as to form two separate rovings 2*a* and 2*b*. The enforced division of the primary roving 2 by the two suction zones 12*a*, 12*b* and the blasting zone 24 between them into two separate rovings 2*a* and 2*b*, which are fed to respective ring spinning stations 3, may be assisted by a succeeding blast nozzle 16, which discharges an air blast that is directed against the suction-free intermediate zone and urges the separate rovings 2*a* and 2*b* apart.

I claim:

1. A process of spinning two fine yarns at respective ring spinning stations, which comprises the sequential steps of (a) drawing a primary roving in a drawing frame to form a drawn primary roving, (b) guiding the drawn primary roving to a conveying surface formed on a part of the periphery of a feed roller, (c) sucking air through two axially juxtaposed and peripherally extending suction zones in the conveying surface to divide the drawn primary roving into two separate rovings, (d) feeding the two separate rovings directly from the conveying surface of the feed roller to the respective spinning stations, and (e) spinning each separate roving into a fine yarn.

2. An apparatus for spinning two fine yarns, which comprises the combination of (a) a drawing frame for drawing a primary roving to form a drawn primary roving, the drawing frame comprising (1) a delivery roller, (b) a conveying means for the drawn primary roving, the conveying means comprising the delivery roller rotatable in a direction of conveyance and the delivery roller constituting a feed roller, the roller comprising (1) a conveying surface receiving the drawn primary roving and defining two axially juxtaposed suction zones peripherally extending in the direction of conveyance and (2) means for sucking air through the suction zones for dividing the drawn primary roving into two separate rovings, and (c) two ring spinning stations respectively arranged to receive a respective one of the two separate rovings from the feed roller and to spin the rovings into fine yarns.

3. The spinning apparatus of claim 2, wherein the conveying surface comprises a suction-free zone intermediate the suction zones, and further comprising a fiber stripper means arranged in the suction-free zone of the conveying surface.

4. The spinning apparatus of claim 2, wherein the drawing frame comprises a further delivery roller cooperating with the delivery roller constituting the feed roller.

5. The spinning apparatus of claim 2, wherein each suction zone is tapered in the direction of conveyance, and the conveying surface has a suction-free zone intermediate the axially juxtaposed suction zones, the intermediate suction-free zone flaring in the direction of conveyance.

6. The spinning apparatus of claim 2, wherein the conveying surface has a delivery end adjacent the ring spinning stations and the suction zones terminate at a distance from the delivery end.

7. The spinning apparatus of claim 6, further comprising a pressure-applying roller between the suction zones and the delivery end for urging the separate rovings against the conveying surface.

8. An apparatus for spinning two fine yarns, which comprises the combination of (a) a drawing frame for drawing a primary roving to form a drawn primary roving, the drawing frame comprising (1) a pair of revolvable drawing elements defining a gap therebetween for receiving the primary roving and for drawing and conveying the primary roving received in the gap in a direction of conveyance, (2) a guide means for the primary roving for guiding the primary roving into the gap, the guide means being adjustable in the direction of the width of the gap, and (3) a pair of cooperating delivery rollers immediately succeeding the drawing elements in the direction of conveyance, (b) means for dividing the drawn primary roving into two separate rovings succeeding the drawing elements in the direction of conveyance, and (c) two ring spinning stations respectively arranged to receive a respective one of the two rovings and to spin the rovings into fine yarns, (1) one of the delivery rollers being arranged to feed the two separate rovings to the respective ring spinning stations.

9. An apparatus for spinning two fine yarns, which comprises the combination of (a) a drawing frame for drawing a primary roving to form a drawn primary roving, the drawing frame comprising (1) a delivery roller, (b) a conveying means for the drawn primary roving, the conveying means comprising the delivery roller rotatable in a direction of conveyance and the delivery roller constituting a feed roller, the roller comprising (1) a conveying surface receiving the drawn primary roving and defining two axially juxtaposed suction zones peripherally extending in the direction of conveyance, the conveying surface comprising a suction-free zone intermediate the suction zones, and (2) means for sucking air through the suction zones for dividing the drawn primary roving into two separate rovings, (c) a fiber stripping brush arranged in the suction-free zone of the conveying surface and cooperating with the conveying surface in the suction-free zone, and (d) two ring spinning stations respectively arranged to receive a respective one of the two separate rovings from the feed roller and to spin the rovings into fine yarns.

10. An apparatus for spinning two fine yarns, which comprises the combination of (a) a drawing frame for drawing a primary roving to form a drawn primary roving, the drawing frame comprising (1) a delivery roller, (b) a conveying means for the drawn primary roving, the conveying means comprising the delivery roller rotatable in a direction of conveyance and the delivery roller constituting a feed roller, the roller comprising (1) a conveying surface receiving the drawn primary roving and defining two axially juxtaposed suction zones peripherally extending in the direction of conveyance and (2) means for sucking air through the suction zones for dividing the drawn primary roving into two separate rovings, (c) an air blast nozzle arranged to direct an air blast against a zone of the conveying surface intermediate the axially juxtaposed suction zones, and (d) two ring spinning stations respectively arranged to receive a respective one of the two separate rovings from the feed roller and to spin the rovings into fine yarns.

11. The spinning apparatus of claim 10, wherein the air blast nozzle is a slot nozzle extending in the direction of conveyance.

12. An apparatus for spinning two fine yarns, which comprises the combination of (a) a drawing frame for drawing a primary roving to form a drawn primary roving, the drawing frame comprising (1) a delivery roller, (b) a conveying means for the drawn primary roving, the conveying means comprising the delivery roller rotatable in a direction of conveyance and the delivery roller constituting a feed roller, the roller comprising (c) means for directing a blast of air into the suction-free zone between the suction zones, and (d) two ring spinning stations respectively arranged to receive a respective one of the two separate rovings from the feed roller and to spin the rovings into fine yarns.

13. The spinning apparatus of claim 12, wherein each suction zone has an end receiving the drawn primary roving and the means for directing a blast of air is arranged close to the receiving ends of the suction zones.

14. The spinning apparatus of claim 13, wherein the means for directing a blast of air is an air blast nozzle arranged to direct the blast of air in the direction of conveyance.

* * * * *